US007398633B1

(12) United States Patent
Chiang

(10) Patent No.: US 7,398,633 B1
(45) Date of Patent: Jul. 15, 2008

(54) BLISTER PACK MAKING MECHANISM

(76) Inventor: Tung-Lung Chiang, No. 20, Min Sheng Rd., Tou Liu City, Yu Lin Hsien (TW)

( * ) Notice: Subject to any disclaimer, the term of this patent is extended or adjusted under 35 U.S.C. 154(b) by 17 days.

(21) Appl. No.: 11/698,905

(22) Filed: Jan. 29, 2007

(51) Int. Cl.
*B65B 11/52* (2006.01)
*B31B 1/64* (2006.01)

(52) U.S. Cl. ..... 53/509; 493/189

(58) Field of Classification Search ..... 53/111 R, 53/510, 509, 550, 562; 493/186, 189
See application file for complete search history.

(56) References Cited

U.S. PATENT DOCUMENTS 4,956,964 A * 9/1990 Jones et al. ..... 53/570

6,318,051 B1 * 11/2001 Preiss ..... 53/493

* cited by examiner

*Primary Examiner*—Louis K. Huynh
*Assistant Examiner*—John Paradiso
(74) *Attorney, Agent, or Firm*—Rosenberg, Klein & Lee

(57) ABSTRACT

A blister pack making mechanism includes a console, a piercing device, a sealing device, and a control unit. A roller and a blower are provided on the console. The roller takes up a bag film. An air inlet block is provided to be inserted into the bag film. A cutting unit is provided on the piercing device for piercing the bag film to admit air to inflate the bag film. The opening of the bag film is sealed up with the sealing device, and the bag film is cut into a proper length to form a blister pack.

9 Claims, 11 Drawing Sheets

BLISTER PACK MAKING MECHANISM

BACKGROUND OF THE INVENTION (a) Field of the Invention

The present invention relates to a blister pack making mechanism, and more particularly to one that having an air inlet block inserted into a bag film to separate an upper layer from an lower layer of the bag film and the lower layer pierced by means of a cutting unit to be inflated with air to form a blister pack.

(b) Description of the Prior Art

To prevent from damage in transit, a package containing an object is usually buffered with a blister pack to fend off impact. The blister pack making machine generally available in the market essentially operates by injecting air into a bag film to inflate it into a blister pack.

As disclosed in M297906 utility patent published in Taiwanese Gazette, a blister pack sealing machine of the prior art is provided with a transmission unit on a console to deliver a bag film; an opening on one side of the bag film is injected into air by means of a blower before being sealed up by a sealing unit in making the blister pack.

However, two layers of the bag film at the opening is difficult to open up before being inflated with air thus to frustrate injection of the air through the opening between two layers of the bag film. Furthermore, the prior art is designed for batch operation involving large quantity thus to prevent customized production depending on the size of individual item of an object to be packaged with the blister pack.

Another prior art as taught in U.S. Pat. No. 4,769,974, two bag films are abutted before being inflated with air to form a blister pack. However, the manufacturing process is found with the defective of poor positioning in abutting both bag films.

SUMMARY OF THE INVENTION

The primary purpose of the present invention is to provide a blister pack making mechanism to correct flaws found in the prior art that prevents easy and precise making of the blister pack. To achieve the purpose, the present invention comprises a console provided with a blower, a support portion disposed at a middle portion of the console, an air outlet is disposed on the support portion, an air inlet block is disposed on the air outlet, and a cutter is disposed at the rear end of the console; a piercing device provided on the console respectively connected to the blower and the air outlet on the support portion is disposed with a first dancer and a cutting unit subject to dialing by the first dancer; a sealing device disposed to the rear end of the piercing device of the console is provided with a heater subject to the dialing by a second dancer disposed on the sealing device; and a control unit disposed on the console comprises a control plate with both ends of the control plate respectively connected to a first driving end and a second driving end for separately driving the first dancer and the second dancer. A roller is provided on the console to take up a roll of a bag film. A powered gear set is provided on an outer side of the console to transmit the bag film. An air duct is disposed between the blower and the piercing device. Two front rollers and two rear rollers are respectively disposed to the front end and the rear end of the support portion; and one of the rear rollers is provided with multiple gaps. The air inlet block is formed with a through hole and multiple air pores. A transmission shaft is pivotally connected to a middle section of the control plate for both the first driving end and the second driving end to respectively execute elevation in curvature to the right and to the left centering around the transmission shaft. The transmission extends to reach the outer side of the console and is connected with a driving plate; the driving plate is provided with a chute containing a rocking arm driven by a motor subject to a controller. A press bar is disposed on top of the heater of the sealing device. The control plate is made in an E shape.

The present invention provides the following advantages:

1. Compact structure allows installation in a limited space and is particularly suitable for batch packaging product involving small quantity.

2. Production of customer size of blister pack in length desired as applicable is feasible to facilitate packaging operation.

3. Inflation can be fast completed since the air inlet block is inserted into the bag film to separate upper and lower layers of the bag film with the lower layer to be pierced to facilitate air injection.

DETAILED DESCRIPTION OF THE PREFERRED EMBODIMENTS

Figure 1:
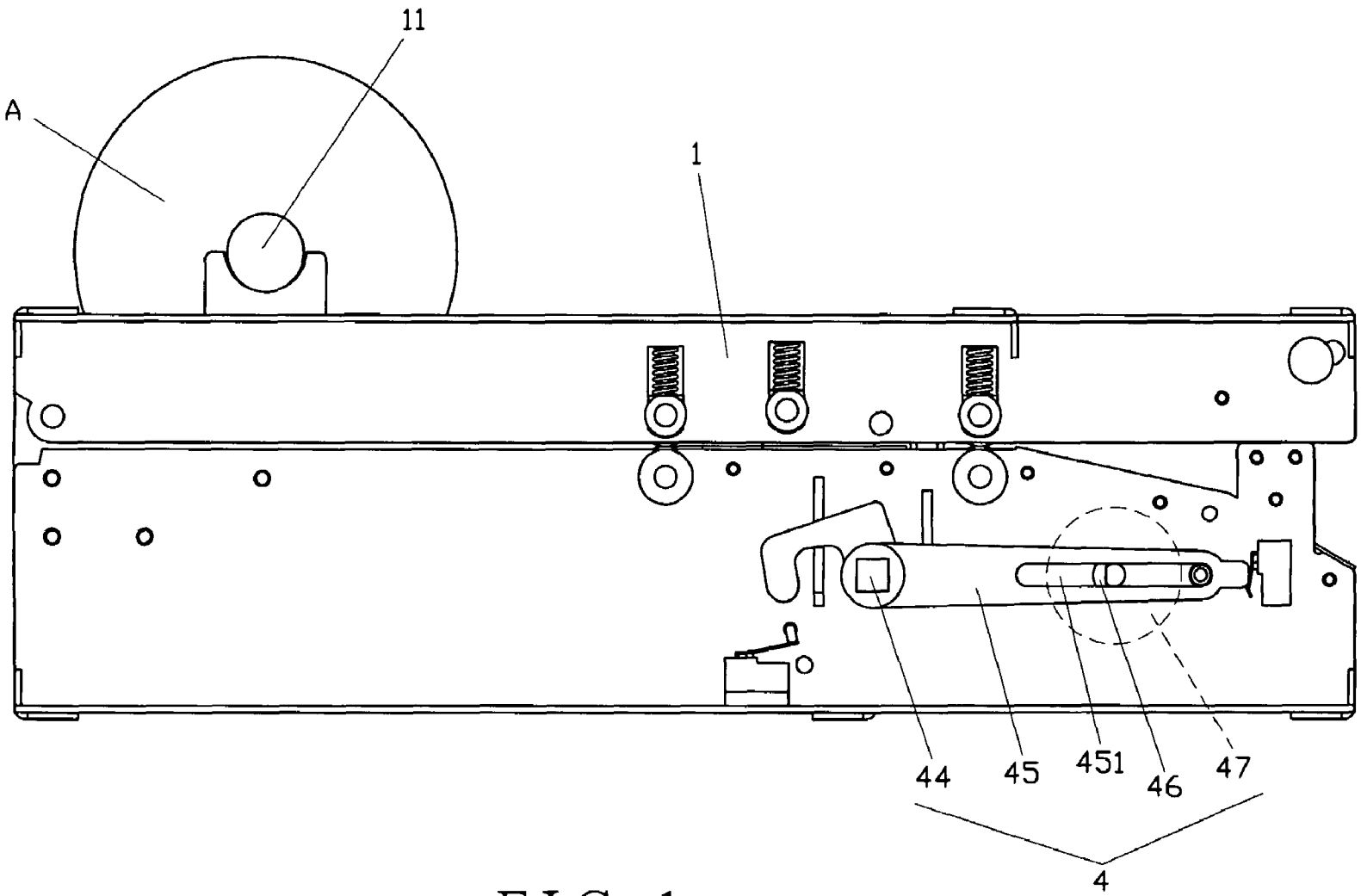
FIG. 1 is a schematic view of an external construction of the present invention.
Figure 2:
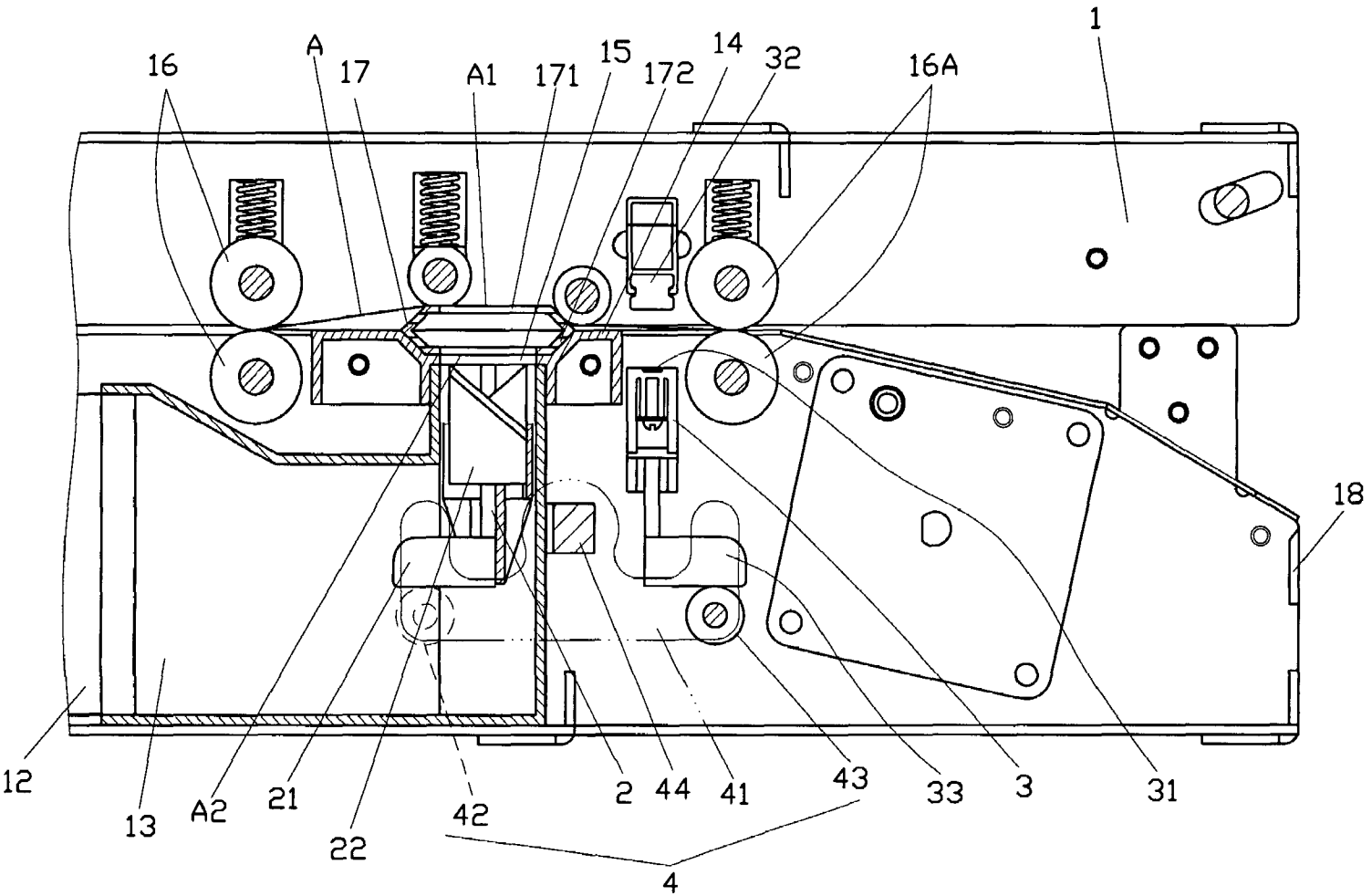
FIG. 2 is a schematic view of an internal construction of the present invention.

Referring to FIGS. 1 and 2, a preferred embodiment of the present invention comprises a console (1), a piercing device (2), a sealing device (3), and a control unit (4).

Figure 3:
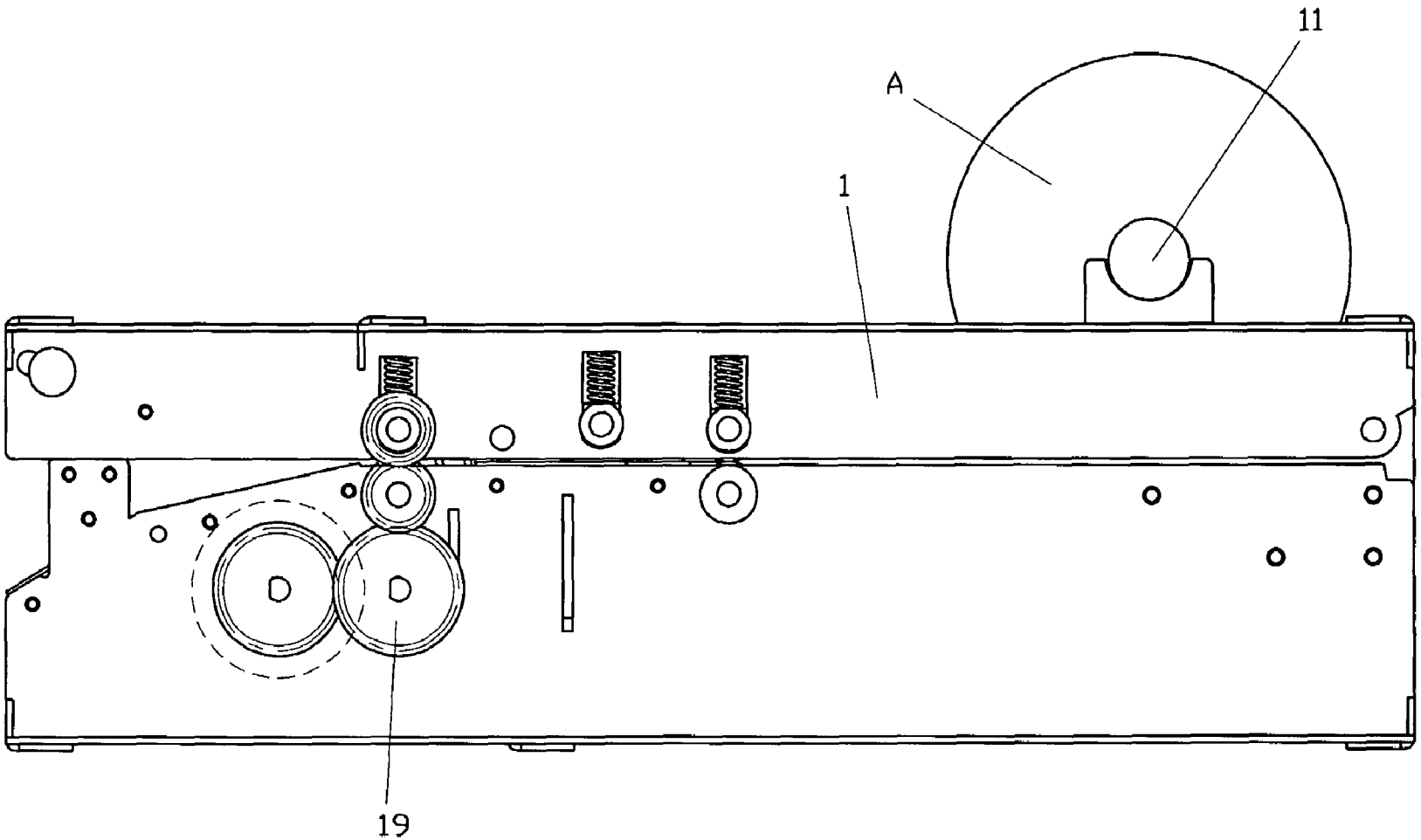
FIG. 3 is a schematic view showing a gear set externally provided to a console of the present invention.
Figure 4:
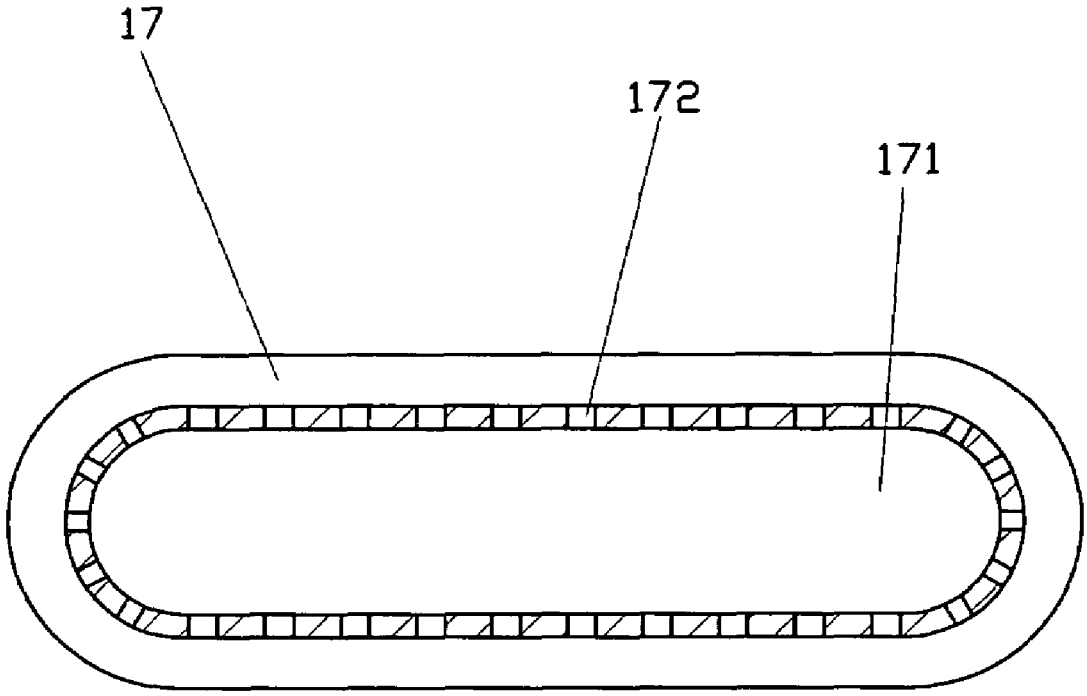
FIG. 4 is a schematic view showing a construction of an air inlet block of the present invention.
Figure 10:
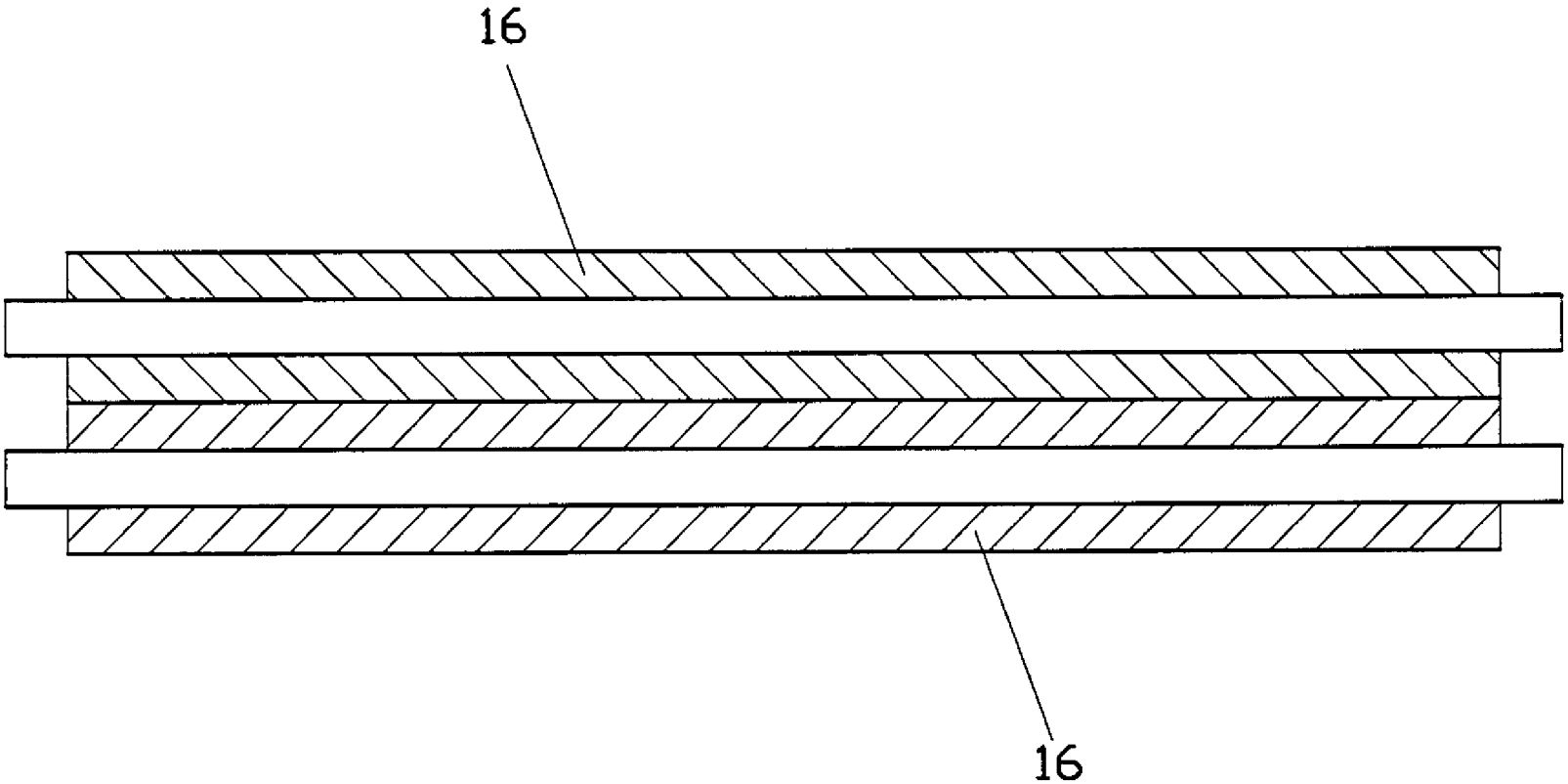
FIG. 10 is a schematic view showing a construction of two front rollers of the present invention.
Figure 11:
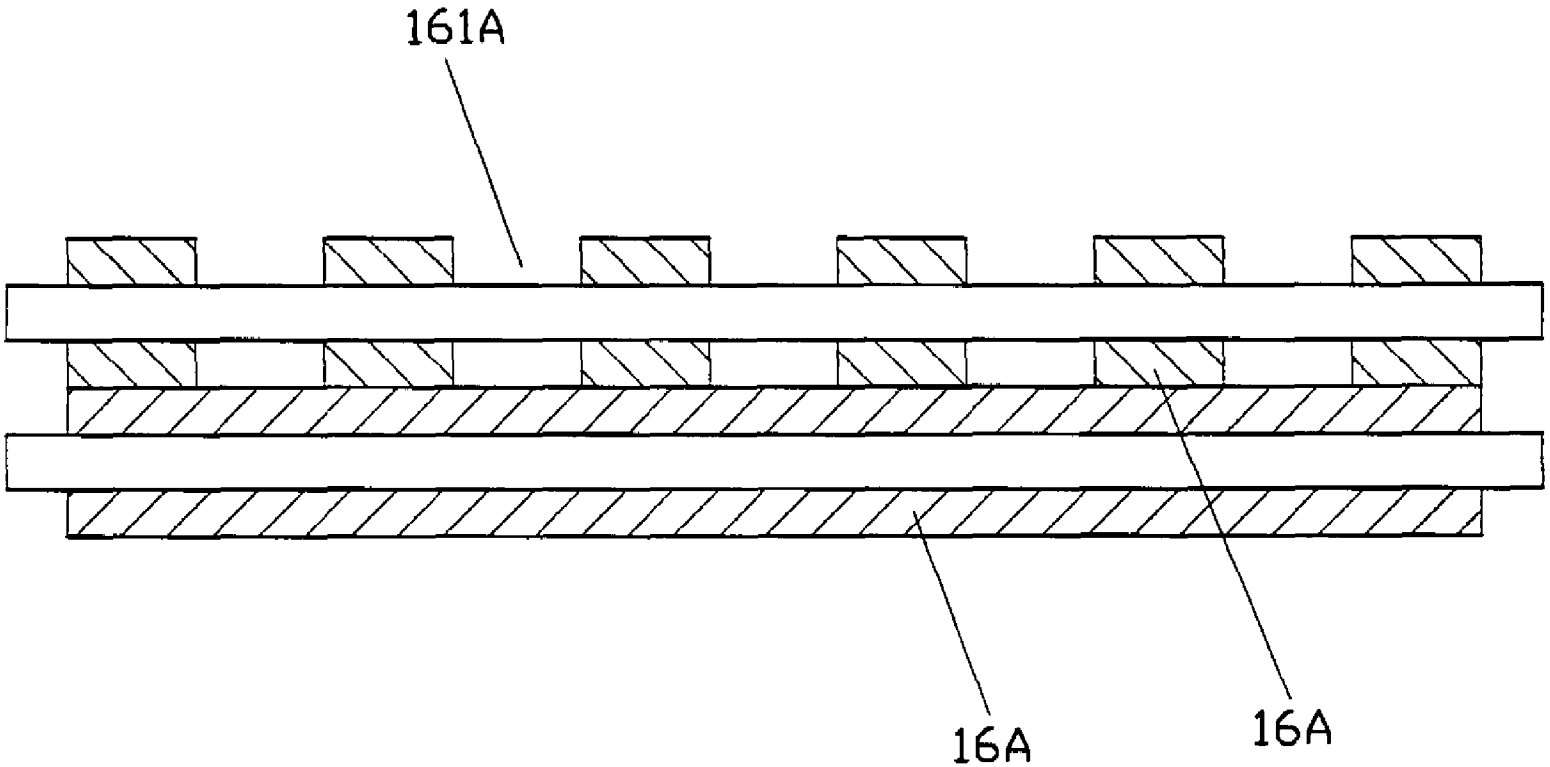
FIG. 11 is a schematic view showing a construction of two rear rollers of the present invention.

A roller (11) is provided at the front of the console (1) to secure a roll of bag film (A). A blower (12) disposed below the roller (11) is provided with an air duct (13) to deliver air. A support portion (14) disposed at the middle of the console (1) has an air outlet (15). Two front rollers (16) as illustrated in FIG. 10 and two rear rollers (16A) as illustrated in FIG. 11 are respectively provided at a front end and a rear end of the support portion (14). Both the front rollers (16) are tightly bound to each other to merely allow the bag film to pass while preventing air escape between the front rollers (16). Similar arrangement is provided to both the rear rollers (16A) with the exception that one of the rear rollers (16A) is formed with multiple gaps (161A) on its perimeter to permit the incoming air to enter into the bag film (A). An air inlet block (17) in rectangle-like shape to be inserted into the interior of the bag film (A) is disposed on top of the air outlet (15) of the support portion (14) as illustrated in FIG. 4. A through hole (171) is provided at the center of the air inlet block (17) and multiple penetrating air pores (172) are disposed around the wall of the air inlet block (17). A cutter (18) is disposed at the rear end of the console (1) and a powered gear set (19) is disposed on an outer side of the console (1), as illustrated in FIG. 3, to facilitate transmission of the bag film (A).

The piercing device (2) is located below the support portion (14) of the console (1). One side of the piercing device (2) is connected to the air inlet (13) of the blower (12), and the top of the piercing device (2) is connected to the air outlet (15) of the support portion (14). A first dancer (21) is disposed on the bottom of the piercing device (2) and a cutting unit (22) is disposed on the top of the piercing device (2). The cutting unit (22) moves up and down in the air outlet (15) of the support portion (14) to extend into the through hole (171) of the air inlet block (17) as the dancer (21) dials up against the cutting unit (22).

The sealing device (3) located at the rear of the piercing device (2) is provided with a heater (31) that moves up and down, and a press bar (32) is provided on top of the heater (31). A second dancer (33) provided on the bottom of the sealing device (3) can be moved up to push the heater (31) to contact with the press bar (32).

Figure 5:
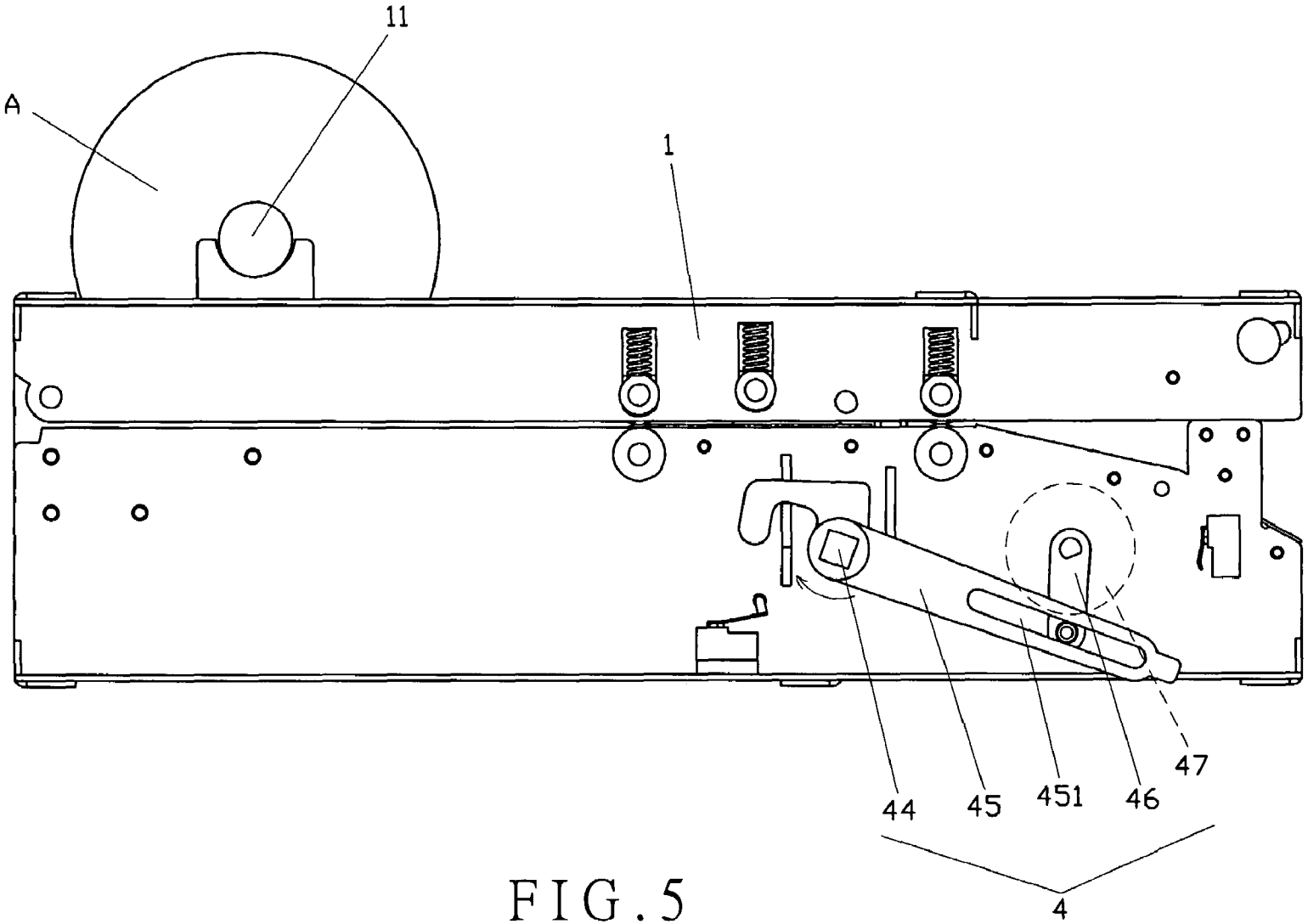
FIG. 5 is a schematic view showing a driving plate to drive a transmission shaft to revolve in a clockwise direction of the present invention.

The control unit (4) disposed on the console (1) comprises an E-shaped control plate (41) with two ends of the control plate (41) respectively connected to a first driving end (42) and a second driving end (43). A transmission shaft (44) is pivotally connected to the center of the control plate (41) for both the first driving end (42) and the second driving end (43) to respectively execute elevation in a curvature fashion to the right and to the left centering around the transmission shaft (44). As shown in FIG. 5, the transmission shaft (44) penetrates the control plate (41) to reach the exterior of the console (1) and is further connected with a driving plate (45). The driving plate (45) has a chute (451). A rocking arm (46) is provided in the chute (451). The rocking arm (46) is driven by a motor (47) through a controller (not illustrated). The controller and the motor (47) are related to a design of control circuit generally known to those who are familiar with the art and will not be elaborated here.

Figure 6:
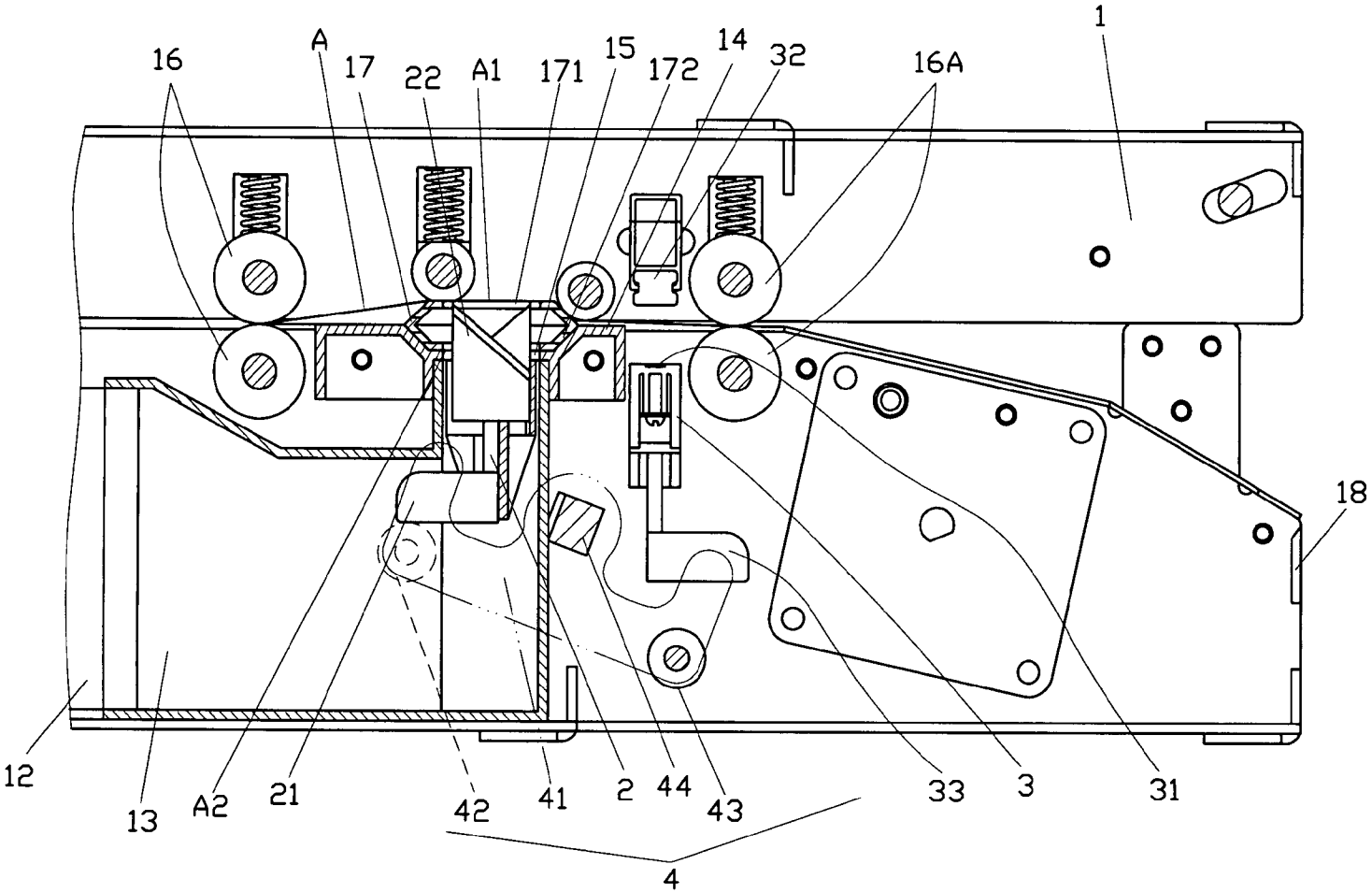
FIG. 6 is a schematic view showing a first driving end of a control plate to dial up a cutting unit of the present invention.
Figure 7:
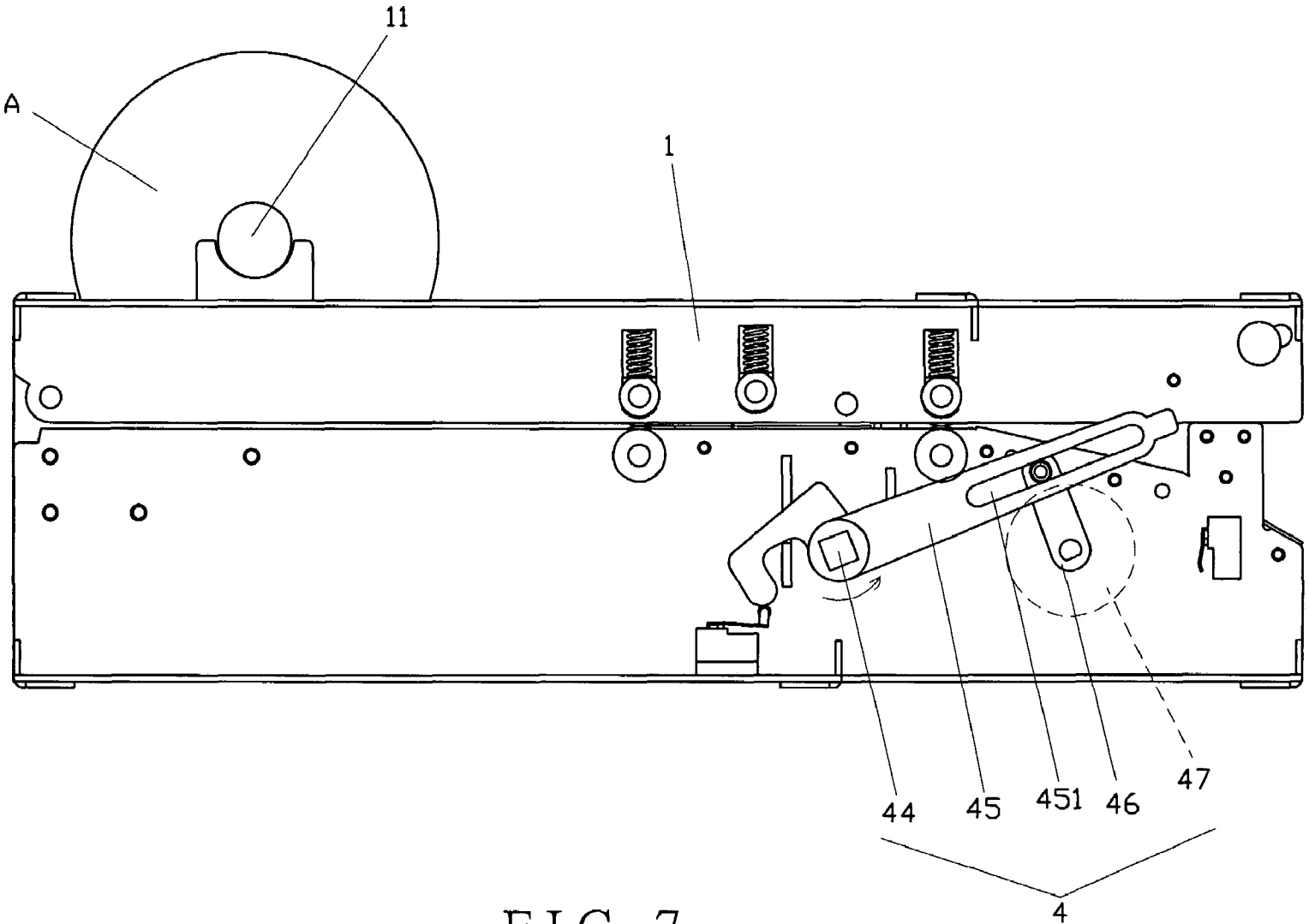
FIG. 7 is a schematic view showing the driving plate to drive the transmission shaft to revolve in a counterclockwise direction of the present invention.
Figure 8:
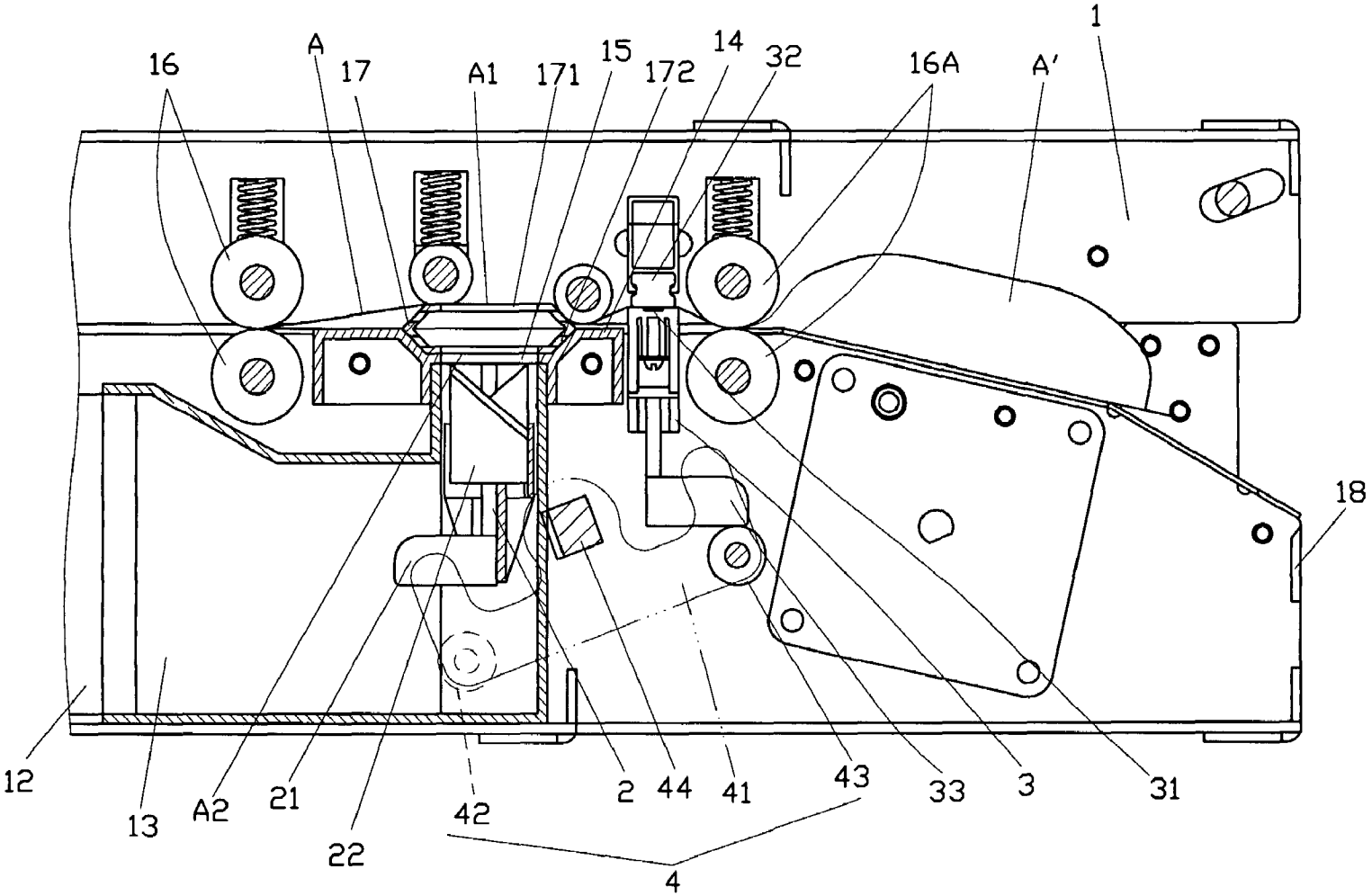
FIG. 8 is a schematic view showing a second driving end of the control plate to dial up a heater of the present invention.
Figure 9:
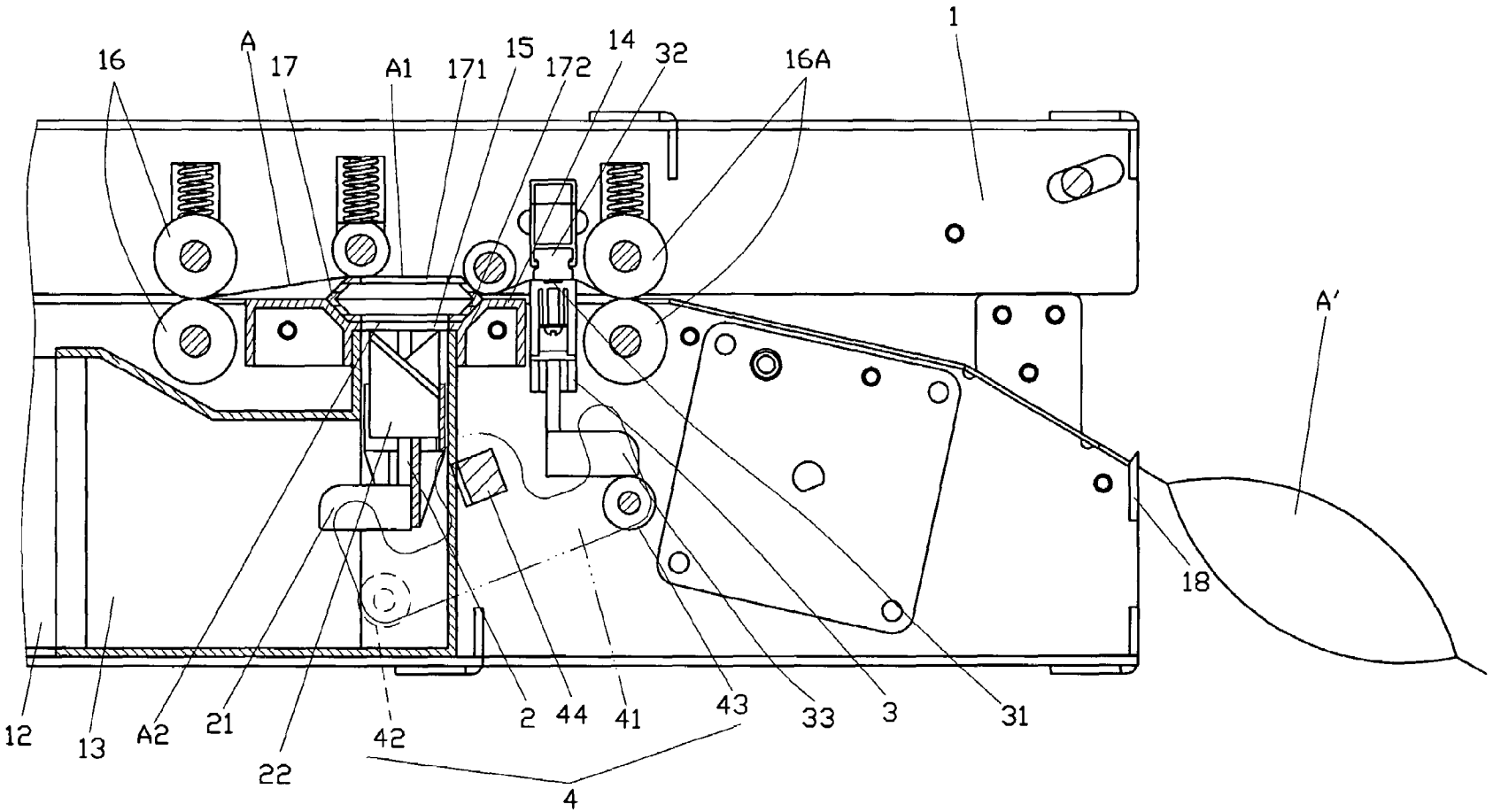
FIG. 9 is a schematic view showing a cutting operation of a blister pack of the present invention.

In operation as illustrated in FIGS. 1 and 2, one end of the bag film (A) is fed through the two front rollers (16) located at the front of the console (1) and the air inlet block (17) is inserted into the bag film (A) to separate an upper layer (A1) from a lower layer (A2). The end of the bag film (A) advances through the two rear rollers (16A), and the controller (not illustrated) is pressed to start the motor (47) to drive the rocking arm (46) to revolve upward in the chute (451) of the driving plate (45), as illustrated in FIGS. 7 and 8, for the transmission shaft (44) connected to the other end of the driving plate (45) to revolve for a proper angle in a counterclockwise direction. As the transmission shaft (44) for the proper angle, it drives at the same time the control plate (41) inside the console (1) to incline to the first driving end (42) for the second driving end (43) to rise. The raised second driving end (43) pushes the heater (31) to contact with the press bar (32) to seal the incoming end of the bag film (A) to complete the first sealing. Depending on the present length of blister pack making as desired, the bag film (A) is transmitted for the proper length through the powered gear set (19) and the controller (not illustrated) is pressed to start the motor (47) so as to drive the rocking arm (46) to revolve downward in the chute (451) of the driving plate (45) as illustrated in FIGS. 5 and 6. Meanwhile, the transmission shaft (44) on the other end of the driving plate (45) revolves in a clockwise direction for a proper angle to drive the control plate (41) in the console (1) to incline to the second driving end (43); and the first driving end (42) of the control plate (41) rises to dial the first dancer (21) of the piercing device (2) for the cutting unit (22) to move up and extend through the air outlet (15) to pierce through the lower layer (A2) of the bag film (A). The air from the blower (12) enters into the interior of the piercing device (2) through the air duct (13) and exports from the air outlet (15). The air is once again imported into the bag film (A) via the through hole (171) and the air pores (172) of the air inlet block (17) until the bag film (A) is inflated with air. Again the controller (not illustrated) is pressed to activate the motor (47) for the rocking arm (46) to revolve upward in the chute (451) of the driving plate (45), as illustrated in FIGS. 7 and 8, for the transmission shaft (44) located at the other end of the driving plate (45) to revolve in a counterclockwise direction for a proper angle. As the transmission shaft (44) revolves, it drives the control plate (41) in the console (1) to incline to the first driving end (42) for the second driving end (43) to rise to push the heater (31) to contact with the press bar (32) to seal the other end of the bag film (A) to complete the secondary sealing to form a blister pack (A'). The gear set (19) then advances the blister pack (A) for a proper cutting range to have the other end of the blister pack (A') cut off by the cutter (18) as illustrated in FIG. 9.

What is claimed is:

1. A blister pack making mechanism, comprising:

a console provided with a blower, a support portion being disposed at a middle portion of the console, an air outlet being disposed on the support portion, an air inlet block being disposed on the front part of the console, and a cutter being disposed at a rear end of the console;

a pair of front rollers and a pair of rear rollers are respectively provided at a front end and a rear end of the support portion;

the air inlet block is formed with a through hole at the center, an upper layer film and an lower layer film leaving the front rollers and approaching the air inlet block, whereby the air inlet block introducing a gas between the upper layer film and the lower layer film in order to separate the upper layer and lower layer films from each other;

a piercing device disposed on the console and connected to the blower and the air outlet of the support portion, the piercing device comprising a first dancer and a cutting unit driven by the first dancer;

a sealing device disposed at a rear end of the support portions of the console, the sealing device comprising a second dancer and a heater driven by the second dancer; and a control unit disposed on the console, the control unit comprising a control plate with two ends connected to a first driving end and a second driving end for driving the first dancer and the second dancer, respectively.

2. The blister pack making mechanism as claimed in claim 1, wherein a powered gear set is provided on an outer side of the console.

3. The blister pack making mechanism as claimed in claim 1, wherein an air duct is provided between the blower and the piercing device.

4. The blister pack making mechanism as claimed in claim 1, one of the rear rollers being formed with a plurality of gaps on its perimeter.

5. The blister pack making mechanism as claimed in claim 1, wherein the air inlet block is formed with a plurality of air pores around an inner wall of the air inlet block.

6. The blister pack making mechanism as claimed in claim 1, wherein a transmission shaft is pivotally connected to a middle section of the control plate.

7. The blister pack making mechanism as claimed in claim 6, wherein the transmission extends to reach the outer side of the console and is connected with a driving plate, the driving plate having a chute, a rocking arm being provided in the chute.

8. The blister pack making mechanism as claimed in claim 1, wherein the sealing device is provided with a press bar disposed on top of the heater.

9. The blister pack making mechanism as claimed in claim 1, wherein the control plate is made in an E-like shape.

* * * * *